US008450986B2

(12) United States Patent
Imura et al.

(10) Patent No.: US 8,450,986 B2
(45) Date of Patent: May 28, 2013

(54) VOLTAGE REGULATOR

(75) Inventors: Takashi Imura, Chiba (JP); Teruo Suzuki, Chiba (JP); Takao Nakashimo, Chiba (JP); Yotaro Nihei, Chiba (JP)

(73) Assignee: Seiko Instruments Inc., Chiba (JP)

( * ) Notice: Subject to any disclaimer, the term of this patent is extended or adjusted under 35 U.S.C. 154(b) by 310 days.

(21) Appl. No.: 12/891,341

(22) Filed: Sep. 27, 2010

(65) Prior Publication Data

US 2011/0074370 A1 Mar. 31, 2011

(30) Foreign Application Priority Data

Sep. 30, 2009 (JP) ..... 2009-228976
Aug. 4, 2010 (JP) ..... 2010-175595

(51) Int. Cl.
*G05F 1/573* (2006.01)

(52) U.S. Cl.
USPC ..... 323/277

(58) Field of Classification Search
USPC ..... 323/276–277
See application file for complete search history.

(56) References Cited

U.S. PATENT DOCUMENTS 4,160,201 A * 7/1979 Ahmed ..... 323/226
6,720,754 B2 * 4/2004 Nakashimo ..... 323/282
2003/0090251 A1 5/2003 Nakashimo
2004/0021518 A1 2/2004 Wrathall
2008/0265852 A1 * 10/2008 Imura ..... 323/277

FOREIGN PATENT DOCUMENTS

JP 2003-029856 A 1/2003

OTHER PUBLICATIONS

Office Action from co-pending U.S. Appl. No. 12/705,796, dated Nov. 21, 2012, 8 pages.
U.S. Appl. No. 12/705,796, filed Feb. 15, 2010 in the United States Patent and Trademark Office.
Final Office Action from co-pending U.S. Appl. No. 12/705,796, dated Mar. 18, 2013, 10 pages.

* cited by examiner

*Primary Examiner* — Jue Zhang
(74) *Attorney, Agent, or Firm* — Brinks Hofer Gilson & Lione

(57) ABSTRACT

Provided is a voltage regulator capable of setting an accurate short-circuit current. Used as a circuit for determining a current value of a short-circuit current of an overcurrent protection circuit is not a resistor for converting current into voltage but a circuit for controlling in the form of current, that is, a circuit of an N-channel depletion type transistor including a gate and a drain that are connected to each other and operating in a non-saturated state. The N-channel depletion type transistor has process fluctuations that are linked with those of a detection transistor, and hence an accurate short-circuit current may be set without trimming.

8 Claims, 5 Drawing Sheets

VOLTAGE REGULATOR

RELATED APPLICATIONS

This application claims priority under 35 U.S.C. §119 to Japanese Patent Application Nos. 2009-228976 filed on Sep. 30, 2009 and 2010-175595 filed on Aug. 4, 2010, the entire contents of which are hereby incorporated by reference.

BACKGROUND OF THE INVENTION

1. Field of the Invention

The present invention relates to a voltage regulator including an overcurrent protection circuit.

2. Description of the Related Art

A conventional voltage regulator is described. FIG. 6 is a circuit diagram illustrating the conventional voltage regulator.

A differential amplifier circuit 104 compares an output voltage of a reference voltage circuit 103 and an output voltage of a voltage dividing circuit 106, and maintains the output terminal voltages of the reference voltage circuit 103 and the voltage dividing circuit 106 at the same level to control a gate voltage of an output transistor 105 so that a voltage of an output terminal 102 is kept at a predetermined voltage.

Here, if the output voltage of the voltage regulator decreases because of an increased load, an output current Iout increases up to a maximum output current Im. Then, in accordance with the maximum output current Im, a large amount of current flows through a sense transistor 121 that is current-mirror-connected to the output transistor 105. On this occasion, a P-channel transistor 601 is turned ON to increase a voltage generated by a single resistor 602, and an N-channel enhancement type transistor 124 approaches an ON state to increase a voltage generated by a resistor 122. Then, a P-channel transistor 125 approaches an ON state to decrease a gate-source voltage of the output transistor 105, with the result that the output transistor 105 approaches an OFF state. Consequently, not exceeding the maximum output current Im, the output current Iout is fixed to the maximum output current Im to decrease an output voltage Vout. Here, the output current Iout is fixed to the maximum output current Im when the gate-source voltage of the output transistor 105 decreases based on the voltage generated by the single resistor 602 and the output transistor 105 approaches the OFF state. Therefore, the maximum output current Im is determined by a resistance of the resistor 602 and a threshold voltage of the N-channel enhancement type transistor 124.

When the output voltage Vout decreases and then a gate-source voltage of the P-channel transistor 601 decreases to be lower than an absolute value Vtp of a threshold voltage of the P-channel transistor 601, the P-channel transistor 601 is turned OFF. A voltage is then generated by both the resistor 602 and a resistor 603, not the single resistor 602, which is so high that the N-channel enhancement type transistor 124 further approaches the ON state. Accordingly, the voltage generated by the resistor 122 further increases and the P-channel transistor 125 further approaches the ON state, with the result that the gate-source voltage of the output transistor 105 further decreases and the output transistor 105 further approaches the OFF state. Consequently, the output current Tout reduces up to a short-circuit current Is. The output voltage Vout thereafter decreases to 0 V. Here, the output current Tout reduces to the short-circuit current Is when the gate-source voltage of the output transistor 105 decreases based on the voltage generated by both the resistors 602 and 603 and the output transistor 105 approaches the OFF state. Therefore, the short-circuit current Is is determined by resistances of both the resistors 602 and 603 (see, for example, Japanese Patent Application Laid-open No. 2003-216252 (FIG. 5)).

In the conventional technology, the maximum output current Im and the short-circuit current Is are determined by the resistances of both the resistors 602 and 603 and the threshold voltage of the N-channel enhancement type transistor 124. Therefore, for accurate setting of the maximum output current Im and the short-circuit current Is, a trimming process is required to set the resistances of the resistors 602 and 603 accurately, which is a problem of the conventional technology that a manufacturing process is complicated.

SUMMARY OF THE INVENTION

The present invention has been made in view of the above-mentioned problem, and therefore provides a voltage regulator capable of setting an accurate short-circuit current with ease.

In order to solve the above-mentioned problem, the present invention provides a voltage regulator including an overcurrent protection circuit, in which the overcurrent protection circuit employs an N-channel depletion type transistor as a circuit capable of setting an accurate current value of a short-circuit current of the overcurrent protection circuit, and the N-channel depletion type transistor includes a gate and a drain that are connected to each other for use in a non-saturated state.

According to the voltage regulator including the overcurrent protection circuit of the present invention, the gate and the drain of the N-channel depletion type transistor in use are connected to each other. Because of a correlation between a resistance of the N-channel depletion type transistor serving as a resistive element and a threshold voltage of an N-channel enhancement type transistor, process fluctuations in short-circuit current and temperature dependence thereof may be minimized. Besides, neither resistor nor fuse is used, and hence a chip area may be reduced as well.

DETAILED DESCRIPTION OF THE PREFERRED EMBODIMENTS

Referring to the accompanying drawings, embodiments of the present invention are described.

First Embodiment

Figure 1:
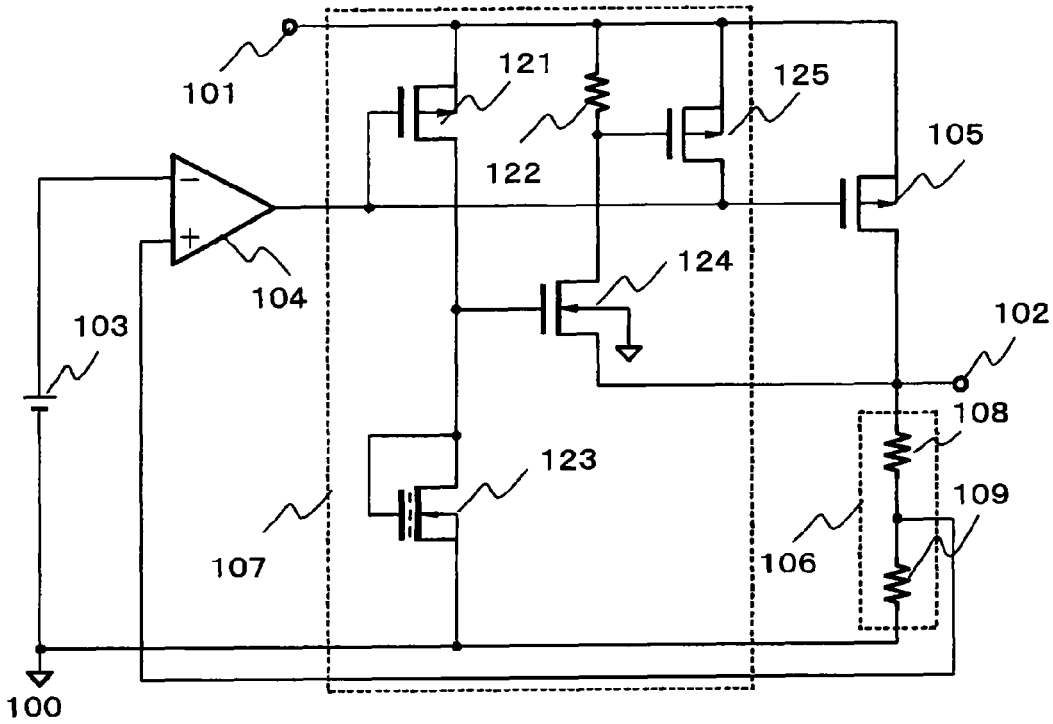
FIG. 1 is a circuit diagram illustrating a voltage regulator according to a first embodiment of the present invention.

FIG. 1 is a circuit diagram illustrating a voltage regulator according to a first embodiment of the present invention.

The voltage regulator according to the first embodiment includes a reference voltage circuit 103, a differential amplifier circuit 104, an output transistor 105, a voltage dividing circuit 106, and an overcurrent protection circuit 107.

Next, connection of the component circuits included in the voltage regulator according to the first embodiment is described.

The reference voltage circuit 103 has an output terminal connected to an inverting input terminal of the differential amplifier circuit 104. The differential amplifier circuit 104 has an output terminal connected to the overcurrent protection circuit 107 and a gate of the output transistor 105, and a non-inverting input terminal connected to an output terminal of the voltage dividing circuit 106. The output transistor 105 has a source connected to a power supply terminal 101 and a drain connected to an output terminal 102. The voltage dividing circuit 106 is connected between the output terminal 102 and a ground terminal 100.

Connection of the overcurrent protection circuit 107 is described.

A P-channel transistor 121 has a gate connected to the gate of the output transistor 105, a drain connected to a gate of an N-channel enhancement type transistor 124, and a source connected to the power supply terminal 101. An N-channel depletion type transistor 123 has a gate and a drain that are connected to the gate of the N-channel enhancement type transistor 124 and the drain of the P-channel transistor 121, and a source connected to the ground terminal 100. The N-channel enhancement type transistor 124 has a source connected to the output terminal 102, a drain connected to a gate of a P-channel transistor 125, and a back gate connected to the ground terminal 100. The P-channel transistor 125 has a drain connected to the gate of the P-channel transistor 105 and a source connected to the power supply terminal 101. A resistor 122 has one end connected to the gate of the P-channel transistor 125 and another end connected to the power supply terminal 101. The N-channel enhancement type transistor 124, the P-channel transistor 125, and the resistor 122 together form an output current limiting circuit for controlling a gate voltage of the output transistor 105.

Next, an operation of the voltage regulator according to the first embodiment is described.

The voltage dividing circuit 106 divides a voltage of the output terminal 102, namely an output voltage Vout, and outputs a divided voltage Vfb. The differential amplifier circuit 104 compares the divided voltage Vfb with a reference voltage Vref of the reference voltage circuit 103, and controls the gate voltage of the output transistor 105 so that the output voltage Vout becomes constant. When the output voltage Vout is higher than a predetermined voltage, that is, when the divided voltage Vfb is higher than the reference voltage Vref, an output signal of the differential amplifier circuit 104 (gate voltage of the output transistor 105) is so high that the output transistor 105 approaches an OFF state. Then, the output voltage Vout decreases. On the other hand, when the output voltage Vout is lower than the predetermined voltage, an operation reversed from the operation described above is performed to increase the output voltage Vout. Thus, the output voltage Vout becomes constant.

Here, if the output terminal 102 and the ground terminal 100 are short-circuited, a high current is caused to flow into the output transistor 105. Accordingly, through the P-channel transistor 121, there flows a current determined by channel lengths and channel widths of the output transistor 105 and the P-channel transistor 121. Then, a gate-source voltage of the N-channel enhancement type transistor 124 rises in proportion to a value of the current. When the gate-source voltage exceeds a threshold voltage of the N-channel enhancement type transistor 124, a voltage generated by the resistor 122 becomes so high that the P-channel transistor 125 approaches an ON state, with the result that a gate-source voltage of the output transistor 105 reduces and the output transistor 105 approaches an OFF state. This way, when the current flows through the P-channel transistor 121, and the N-channel enhancement type transistor 124 detects an increase of the current in the form of voltage, the overcurrent protection circuit is enabled.

In the N-channel depletion type transistor 123, the gate is connected to the drain. Such connection allows the N-channel depletion type transistor 123 to operate in a non-saturated region, which may be regarded as equivalent to a detection resistor. An N-channel depletion type transistor and an N-channel enhancement type transistor are adjusted in threshold by ion implantation using the same apparatus with the same ion at varying concentrations. Determined by the ion implantation using the same apparatus with the same ion at merely different concentrations, the thresholds of the two types of transistor fluctuate in the same direction if apparatus fluctuations are present to fluctuate the thresholds. For example, if there are upward fluctuations in threshold of N-channel depletion type transistors, there are similar upward fluctuations in threshold of N-channel enhancement type transistors. Upward fluctuations in threshold of N-channel depletion type transistors do not co-occur with downward fluctuations in threshold of N-channel enhancement type transistors. Further, the degree of fluctuations does not vary largely therebetween, which prevents, for example, the case where a threshold of an N-channel depletion type transistor increases by 0.1 V whereas a threshold of an N-channel enhancement type transistor increases by 0.01 V. In other words, the fluctuations in threshold of N-channel depletion type transistors and the fluctuations in threshold of N-channel enhancement type transistors are linked together in terms of process fluctuations (threshold fluctuations). Therefore, the detection resistor is linked with the N-channel enhancement type transistor 124 in terms of process fluctuations (threshold fluctuations).

This way, a resistance of the detection resistor, which is responsible for process fluctuations in short-circuit current, and the threshold of the N-channel enhancement type transistor 124 for detection are linked together, to thereby minimize the process fluctuations in short-circuit current and temperature dependence thereof. Besides, neither resistor nor fuse is used for suppressing the process fluctuations, which is another advantage of reducing a chip area.

Note that, although not illustrated, the same operation may also be made by replacing the resistor 122 with a P-channel transistor, in which a gate and a source are connected to each other, the gate is connected also to the gate of the P-channel transistor 125 and the drain of the N-channel enhancement type transistor 124, and the source is connected also to the power supply terminal 101.

As described above, the N-channel depletion type transistor, in which the gate and the drain are connected to each other, is used as the detection resistor, to thereby minimize the process fluctuations in short-circuit current and the temperature dependence thereof. Besides, the chip area may be reduced.

Second Embodiment

Figure 2:
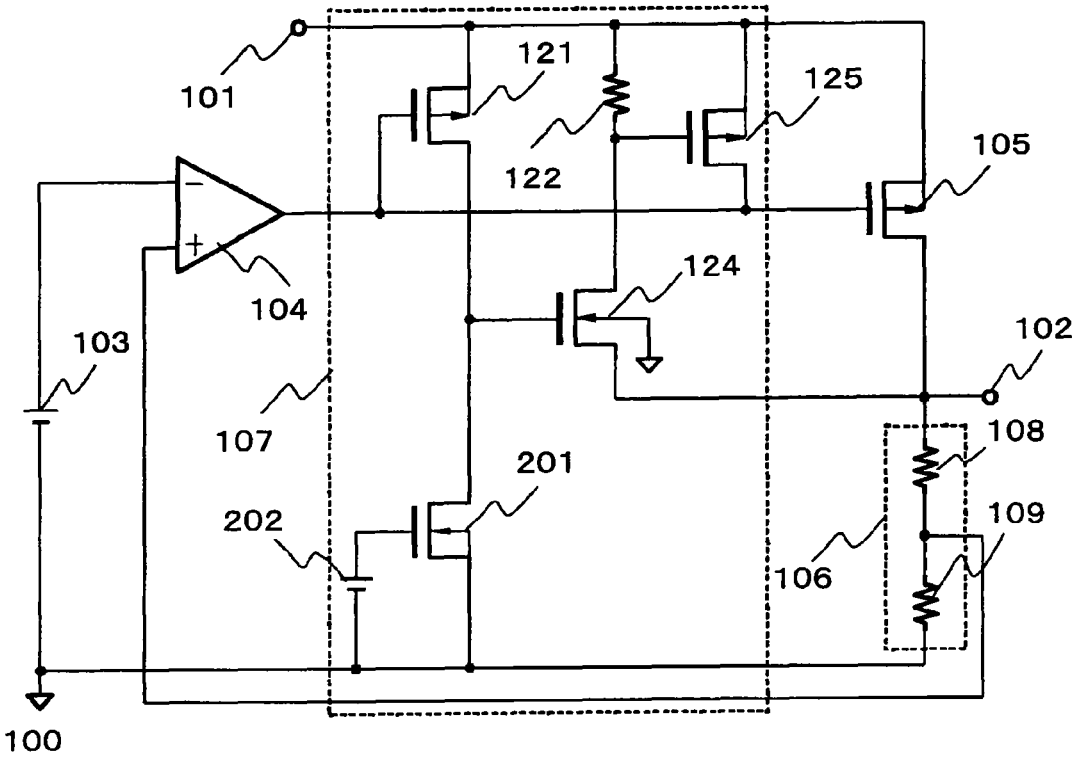
FIG. 2 is a circuit diagram illustrating a voltage regulator according to a second embodiment of the present invention.

FIG. 2 is a circuit diagram illustrating a voltage regulator according to a second embodiment of the present invention.

The voltage regulator according to the second embodiment includes the reference voltage circuit 103, the differential amplifier circuit 104, the output transistor 105, the voltage dividing circuit 106, and the overcurrent protection circuit 107. A difference from the first embodiment resides in that an N-channel enhancement type transistor 201 is used instead of the N-channel depletion type transistor 123, which has a gate connected to a constant voltage circuit 202.

Next, an operation of the voltage regulator according to the second embodiment is described.

The N-channel enhancement type transistor 201 has the gate connected to the constant voltage circuit 202 and operates in a non-saturated region. Because of the non-saturated operation, the N-channel enhancement type transistor 201 may be regarded as a detection resistor. This detection resistor is an N-channel enhancement type transistor and accordingly has process fluctuations (threshold fluctuations) that are linked with those of the N-channel enhancement type transistor 124. A resistance of the detection resistor and a threshold of the N-channel enhancement type transistor 124 for detection are linked together, to thereby minimize process fluctuations in short-circuit current and temperature dependence thereof. Neither resistor nor fuse is used for suppressing the process fluctuations, which is another advantage of reducing a chip area.

As described above, the N-channel enhancement type transistor, in which the gate is connected to the constant voltage circuit to enable the non-saturated operation, is used as the detection resistor, to thereby minimize the process fluctuations in short-circuit current and the temperature dependence thereof. Besides, the chip area may be reduced.

Third Embodiment

Figure 3:
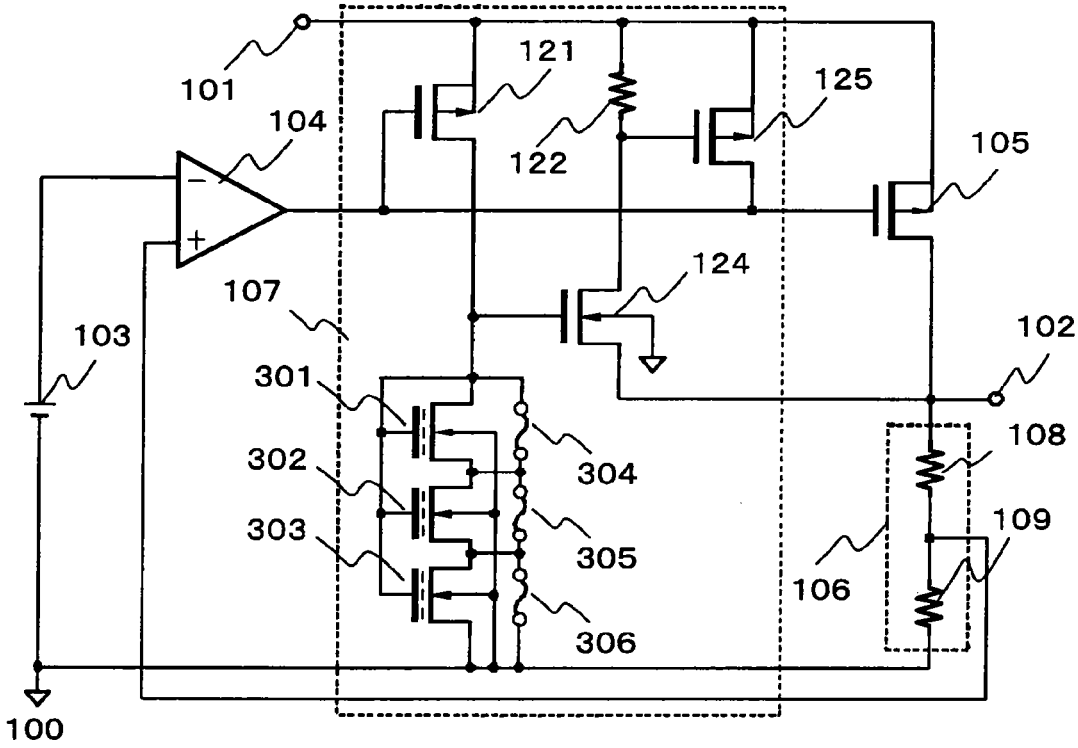
FIG. 3 is a circuit diagram illustrating a voltage regulator according to a third embodiment of the present invention.

FIG. 3 is a circuit diagram illustrating a voltage regulator according to a third embodiment of the present invention.

The voltage regulator according to the third embodiment includes the reference voltage circuit 103, the differential amplifier circuit 104, the output transistor 105, the voltage dividing circuit 106, and the overcurrent protection circuit 107. A difference from the first embodiment resides in that series-connected N-channel depletion type transistors 301, 302, and 303 are used instead of the N-channel depletion type transistor 123, which may be trimmed with the use of fuses.

Next, an operation of the voltage regulator according to the third embodiment is described.

The N-channel depletion type transistors 301, 302, and 303 may be trimmed with the use of the fuses. Similarly to the first embodiment, respective gates of the N-channel depletion type transistors 301, 302, and 303 are connected to a drain of the N-channel depletion type transistor 301 to allow the N-channel depletion type transistors 301, 302, and 303 to operate in a non-saturated region, which may be regarded as a detection resistor. Characteristics of the overcurrent protection circuit are determined by resistances of the N-channel depletion type transistors serving as the detection resistor. Depending on a voltage range, appropriate characteristics of the overcurrent protection circuit cannot be obtained. To correct inappropriate characteristics thereof to appropriate ones, the N-channel depletion type transistors are trimmed. Through the trimming, the detection resistor may take an optimum resistance value. Note that, three N-channel depletion type transistors and three fuses are connected in series, respectively, but the numbers thereof are not limited to three, and four or more N-channel depletion type transistors and four or more fuses may be connected in series, respectively.

Similarly to the first embodiment, the detection resistor includes N-channel depletion type transistors and accordingly has process fluctuations (threshold fluctuations) that are linked with those of the N-channel enhancement type transistor 124. A resistance of the detection resistor and a threshold of the N-channel enhancement type transistor 124 for detection are linked together, to thereby minimize process fluctuations in short-circuit current and temperature dependence thereof.

As described above, the N-channel depletion type transistors, in which each gate and each drain are connected to each other, are used as the detection resistor, to thereby minimize the process fluctuations in short-circuit current and the temperature dependence thereof. Besides, when the N-channel depletion type transistors are trimmed, optimum characteristics of the overcurrent protection circuit may be obtained.

Fourth Embodiment

Figure 4:
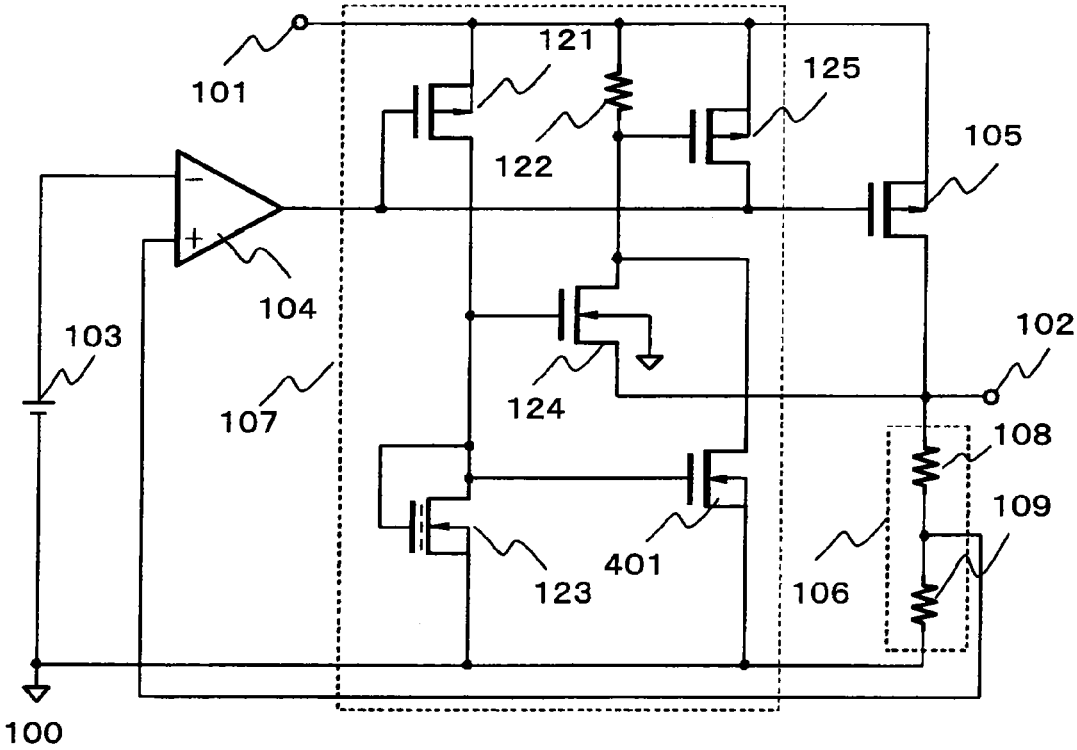
FIG. 4 is a circuit diagram illustrating a voltage regulator according to a fourth embodiment of the present invention.

FIG. 4 is a circuit diagram illustrating a voltage regulator according to a fourth embodiment of the present invention.

The voltage regulator according to the fourth embodiment includes the reference voltage circuit 103, the differential amplifier circuit 104, the output transistor 105, the voltage dividing circuit 106, and the overcurrent protection circuit 107. A difference from the first embodiment resides in that an N-channel enhancement type transistor 401 is used, which has a gate connected to the drain of the N-channel depletion type transistor 123, a drain connected to the drain of the N-channel enhancement type transistor 124, and a source connected to the ground terminal 100.

Next, an operation of the voltage regulator according to the fourth embodiment is described.

If the output terminal 102 and the ground terminal 100 are short-circuited, a high current is caused to flow into the output transistor 105. Accordingly, through the P-channel transistor 121, there flows a current determined by channel lengths and channel widths of the output transistor 105 and the P-channel transistor 121. Then, a gate-source voltage of the N-channel enhancement type transistor 401 rises in proportion to a value of the current. When the gate-source voltage exceeds a threshold voltage of the N-channel enhancement type transistor 401, a voltage generated by the resistor 122 becomes so high that the P-channel transistor 125 approaches an ON state, with the result that a gate-source voltage of the output transistor 105 reduces and the output transistor 105 approaches an OFF state. Then, the output voltage Vout decreases. This way, when the current flows through the P-channel transistor 121, and the N-channel enhancement type transistor 401 detects an increase of the current in the form of voltage, a drooping type overcurrent protection circuit is enabled.

When the output voltage Vout decreases to be equal to or lower than a predetermined voltage Va, a gate-source voltage of the N-channel enhancement type transistor 124 becomes equal to or higher than its threshold voltage to turn ON the N-channel enhancement type transistor 124. Then, the voltage generated by the resistor 122 further increases and the P-channel transistor 125 further approaches the ON state, with the result that the gate-source voltage of the output transistor 105 further reduces and the output transistor 105 further approaches the OFF state. This way, when the current flows through the P-channel transistor 121, and the N-channel enhancement type transistor 124 detects an increase of the current in the form of voltage, a fold-back type overcurrent protection circuit is enabled.

Here, in the N-channel depletion type transistor 123, the gate is connected to the drain. Such connection allows the N-channel depletion type transistor 123 to operate in a non-saturated region, which may be regarded as equivalent to a detection resistor. This detection resistor is an N-channel depletion type transistor and accordingly has process fluctuations (threshold fluctuations) that are linked with those of the N-channel enhancement type transistor 124 and those of the N-channel enhancement type transistor 401. A resistance of the detection resistor and a threshold of the N-channel enhancement type transistor 401 for detection in the drooping type overcurrent protection circuit as well as a threshold of the N-channel enhancement type transistor 124 for detection in the fold-back type overcurrent protection circuit are linked together, to thereby minimize process fluctuations in short-circuit current and temperature dependence thereof. Besides, neither resistor nor fuse is used for suppressing the process fluctuations, which is another advantage of reducing a chip area.

As described above, the N-channel depletion type transistor, in which the gate and the drain are connected to each other, is used instead of a detection resistor, to thereby minimize the process fluctuations in short-circuit current and the temperature dependence thereof. Besides, the chip area may be reduced.

Fifth Embodiment

Figure 5:
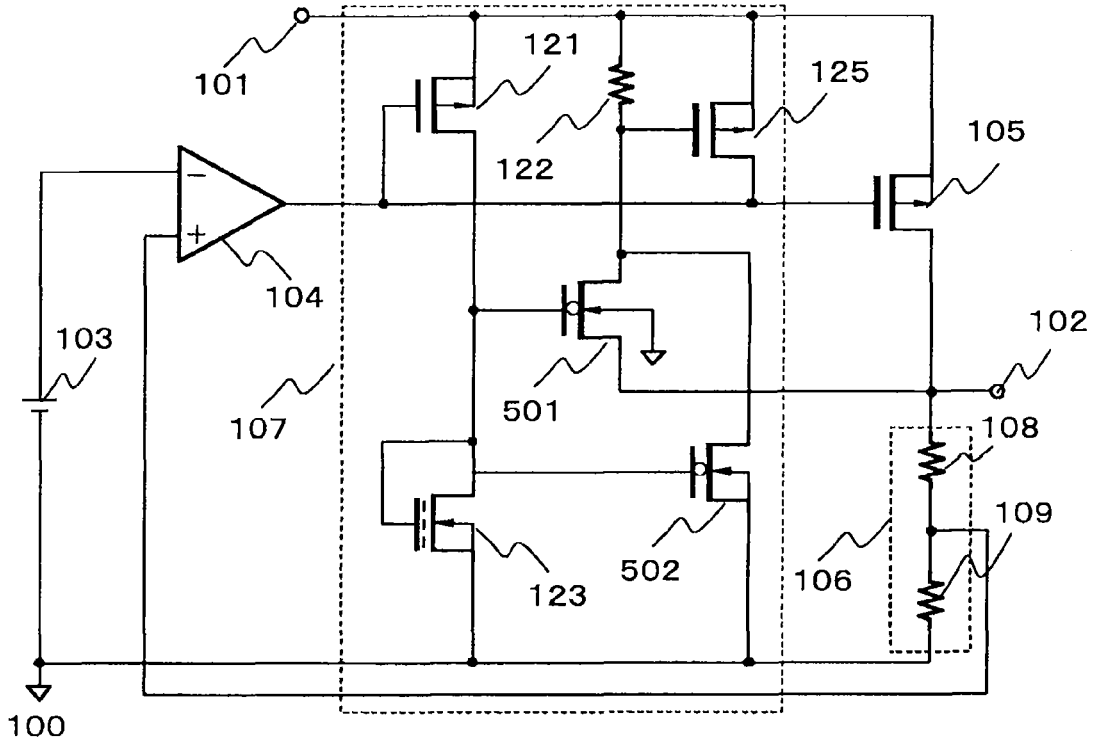
FIG. 5 is a circuit diagram illustrating a voltage regulator according to a fifth embodiment of the present invention.
Figure 6:
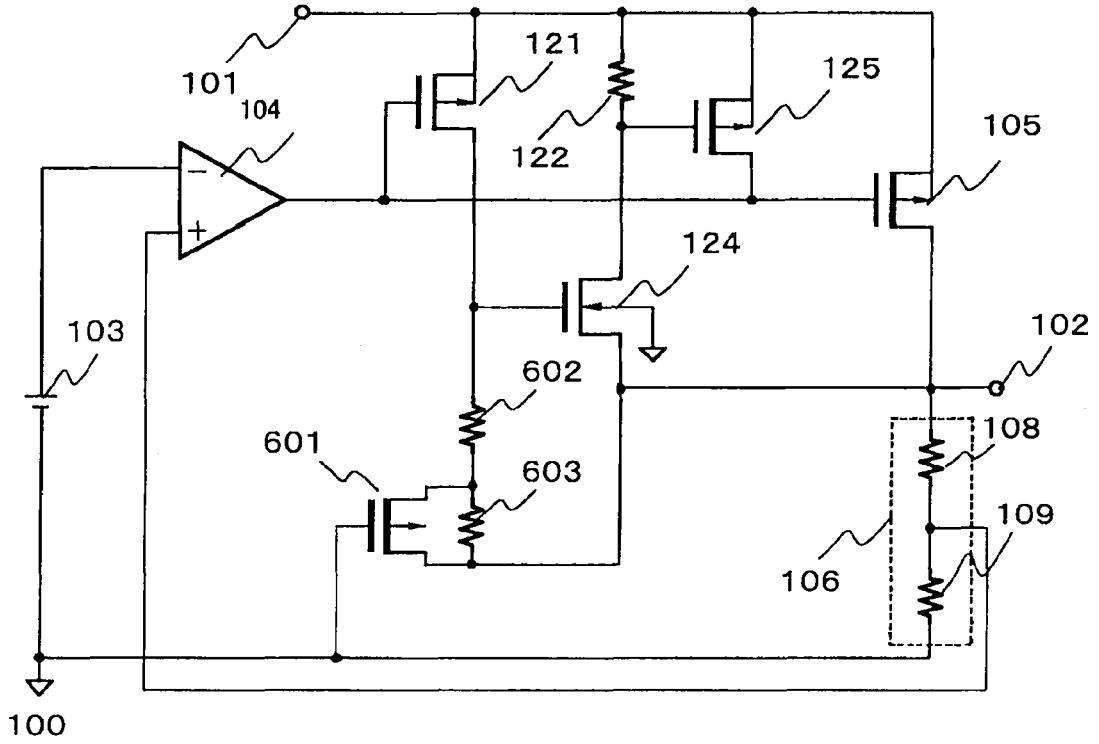
FIG.6 Prior Art
FIG. 6 is a circuit diagram illustrating a conventional voltage regulator.

FIG. 5 is a circuit diagram illustrating a voltage regulator according to a fifth embodiment of the present invention.

The voltage regulator according to the fifth embodiment includes the reference voltage circuit 103, the differential amplifier circuit 104, the output transistor 105, the voltage dividing circuit 106, and the overcurrent protection circuit 107. A difference from the fourth embodiment resides in that N-channel initial transistors 501 and 502 are used instead of the N-channel enhancement type transistor 124 and the N-channel enhancement type transistor 401.

Next, an operation of the voltage regulator according to the fifth embodiment is described.

Each of the N-channel initial transistors 501 and 502 is an N-channel enhancement type transistor provided on a P-substrate, which is formed without ion implantation into a well. No ion implantation is performed into the well, and hence no process fluctuation occurs among thresholds.

In the N-channel depletion type transistor 123, the gate and the drain are connected to each other. Such connection allows the N-channel depletion type transistor 123 to operate in a non-saturated region, which may be regarded as equivalent to a detection resistor.

In this case, the N-channel initial transistors 501 and 502 suffer from no fluctuations in threshold, and hence only the detection resistor is responsible for process fluctuations in short-circuit current and temperature dependence thereof. Because only the detection resistor suffers from process fluctuations, the process fluctuations in short-circuit current and the temperature dependence thereof may be minimized. Besides, neither resistor nor fuse is used for suppressing the process fluctuations, which is another advantage of reducing a chip area.

As described above, the N-channel depletion type transistor, in which the gate and the drain are connected to each other, is used instead of a detection resistor, and the N-channel initial transistors are used for detection to eliminate process fluctuations regarding N-channel enhancement type transistors, to thereby minimize the process fluctuations in short-circuit current and the temperature dependence thereof. Besides, the chip area may be reduced.

Note that, this embodiment uses the N-channel initial transistor as a transistor for detection, but the N-channel initial transistor is also applicable to the circuits of the other embodiments to obtain the same effects.

Sixth Embodiment

Figure 7:
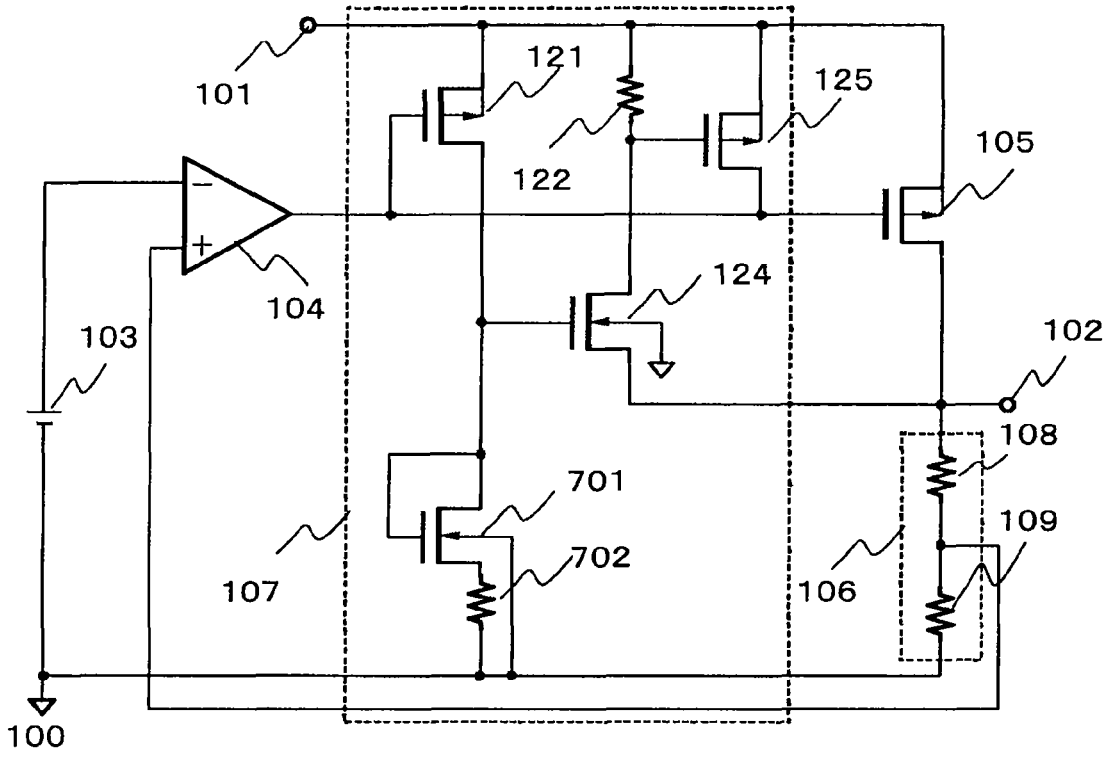
FIG. 7 is a circuit diagram illustrating a voltage regulator according to a sixth embodiment of the present invention.

FIG. 7 is a circuit diagram illustrating a voltage regulator according to a sixth embodiment of the present invention.

The voltage regulator according to the sixth embodiment includes the reference voltage circuit 103, the differential amplifier circuit 104, the output transistor 105, the voltage dividing circuit 106, and the overcurrent protection circuit 107. A difference from the first embodiment resides in that the N-channel depletion type transistor 123 is replaced with an N-channel enhancement type transistor 701, and a resistor 702 is connected to a source of the N-channel enhancement type transistor 701.

Next, an operation of the voltage regulator according to the sixth embodiment is described.

The N-channel enhancement type transistors 701 and 124 are of the same type of transistor, and hence process fluctuations in short-circuit current and temperature dependence thereof may be minimized. Further, by the resistor 702, it is possible to adjust a current flowing through the N-channel enhancement type transistor 701 and thereby adjust at what current value the overcurrent protection is enabled. Besides, neither resistor nor fuse is used for suppressing the process fluctuations, which is another advantage of reducing a chip area.

As described above, the N-channel enhancement type transistor, in which the gate and the drain are connected to each other and the source is connected to the resistor, is used instead of a detection resistor, to thereby minimize the process fluctuations in short-circuit current and the temperature dependence thereof while adjusting at what current value the overcurrent protection is enabled. Besides, the chip area may be reduced.

Seventh Embodiment

Figure 8:
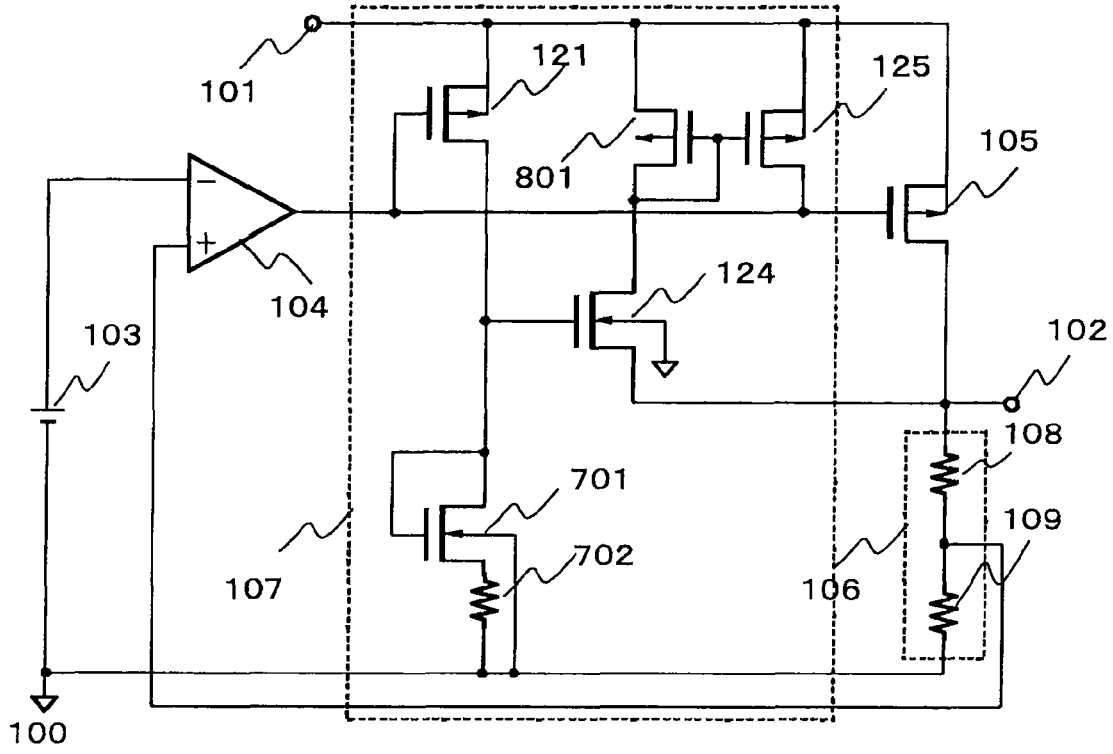
FIG. 8 is a circuit diagram illustrating a voltage regulator according to a seventh embodiment of the present invention.

FIG. 8 is a circuit diagram illustrating a voltage regulator according to a seventh embodiment of the present invention.

The voltage regulator according to the seventh embodiment includes the reference voltage circuit 103, the differential amplifier circuit 104, the output transistor 105, the voltage dividing circuit 106, and the overcurrent protection circuit 107. A difference from the sixth embodiment resides in that the resistor 122 is replaced with a P-channel transistor 801, in which a gate and a drain are connected to each other and further connected to the P-channel transistor 125.

Next, an operation of the voltage regulator according to the seventh embodiment is described.

The use of the P-channel transistor 801 also enables the P-channel transistor 125 to be turned ON when a gate-source voltage of the N-channel enhancement type transistor 124 rises to exceed its threshold. Therefore, the voltage regulator of the seventh embodiment may operate similarly to that of the sixth embodiment.

As described above, even if the resistor 122 is replaced with the P-channel transistor 801, similarly to the voltage regulator according to the sixth embodiment, the process fluctuations in short-circuit current and the temperature dependence thereof may be minimized. Further, at what current value the overcurrent protection is enabled may be adjusted, and a chip area may be reduced as well.

Eighth Embodiment

Figure 9:
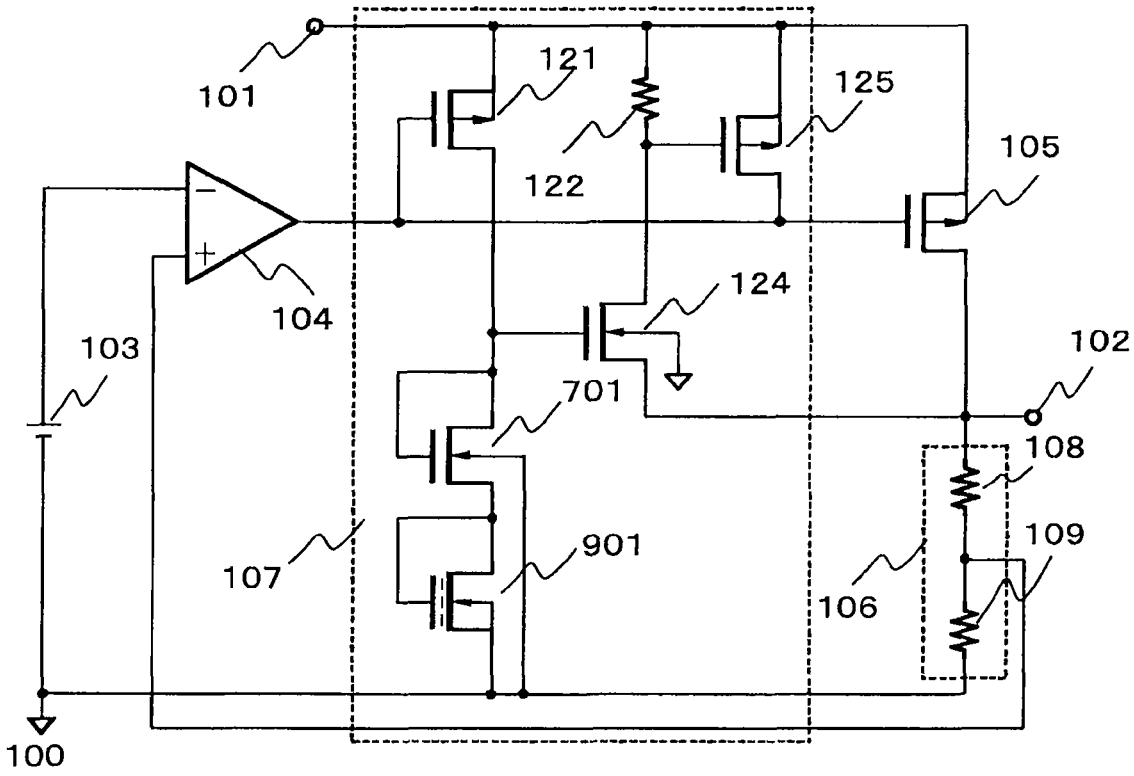
FIG. 9 is a circuit diagram illustrating a voltage regulator according to an eighth embodiment of the present invention.

FIG. 9 is a circuit diagram illustrating a voltage regulator according to an eighth embodiment of the present invention.

The voltage regulator according to the eighth embodiment includes the reference voltage circuit 103, the differential amplifier circuit 104, the output transistor 105, the voltage dividing circuit 106, and the overcurrent protection circuit 107. A difference from the sixth embodiment resides in that the resistor 702 is replaced with an N-channel depletion type transistor 901, in which a gate and a drain are connected to each other.

Next, an operation of the voltage regulator according to the eighth embodiment is described.

The N-channel enhancement type transistors 701 and 124 are of the same type of transistor, and the N-channel depletion type transistor 901 is adjusted by ion implantation using the same apparatus as those for the N-channel enhancement type transistors 701 and 124. Therefore, process fluctuations in short-circuit current and temperature dependence thereof may be minimized. Further, by the N-channel depletion type transistor 901, it is possible to adjust a current flowing through the N-channel enhancement type transistor 701 and thereby adjust at what current value the overcurrent protection is enabled. Then, it is also possible to reduce a chip area compared with the case where a resistor is used for such adjustment. Besides, neither resistor nor fuse is used for suppressing the process fluctuations, which is another advantage of reducing a chip area.

As described above, when the resistor 702 is replaced with the N-channel depletion type transistor 901, it is possible to adjust at what current value the overcurrent protection is enabled, while reducing a chip area. Further, the process fluctuations in short-circuit current and the temperature dependence thereof may be minimized.

Note that, although not illustrated, the same operation may also be made by replacing the resistor 122 with a P-channel transistor, in which a gate and a source are connected to each other, the gate is connected also to the gate of the P-channel transistor 125 and the drain of the N-channel enhancement type transistor 124, and the source is connected also to the power supply terminal 101.

What is claimed is:

1. A voltage regulator, comprising:

an error amplifier circuit for amplifying and outputting a difference between a divided voltage determined by dividing an output voltage of an output transistor, and a reference voltage, to control a gate of the output transistor; and an overcurrent protection circuit for detecting an overcurrent flowing into the output transistor to limit a current of the output transistor, wherein the overcurrent protection circuit comprises:

a sense transistor controlled by an output voltage of the error amplifier circuit, for sensing an output current of the output transistor;

a first transistor comprising an N-channel depletion type transistor or an N-channel enhancement type transistor having a gate connected to a drain thereof and that operates in a non-saturated region, for generating a voltage based on a current flowing through the sense transistor; and an output current limiting circuit controlled by the voltage generated by the first transistor, for limiting a gate voltage of the output transistor.

2. A voltage regulator according to claim 1, wherein the N-channel depletion type transistor comprises:

a plurality of N-channel depletion type transistors connected in series; and a fuse for trimming connected in parallel to each of the plurality of N-channel depletion type transistors.

3. A voltage regulator, comprising:

an error amplifier circuit for amplifying and outputting a difference between a divided voltage determined by dividing an output voltage of an output transistor, and a reference voltage, to control a gate of the output transistor; and an overcurrent protection circuit for detecting an overcurrent flowing into the output transistor to limit a current of the output transistor, wherein the overcurrent protection circuit comprises:

a sense transistor controlled by an output voltage of the error amplifier circuit, for sensing an output current of the output transistor;

a first transistor that operates in a non-saturated region, for generating a voltage based on a current flowing through the sense transistor, wherein a source of the sense transistor is connected to a drain of the first transistor; and an output current limiting circuit controlled by the voltage generated by the first transistor, for limiting a gate voltage of the output transistor.

4. A voltage regulator according to claim 1, wherein the voltage regulator further comprises a resistor connected to a source of the N-channel enhancement type transistor.

5. A voltage regulator according to claim 1, wherein the voltage regulator further comprises a second N-channel depletion type transistor connected to a source of the N-channel enhancement type transistor, the second N-channel depletion type transistor including a gate and a drain that are connected to each other.

6. A voltage regulator according to claim 1, wherein the output current limiting circuit comprises a second transistor for detecting the voltage generated by the first transistor, and wherein the second transistor comprises an initial transistor.

7. A voltage regulator according to claim 6, wherein the output current limiting circuit further comprises a third transistor connected to a drain of the second transistor, and wherein the third transistor comprises a P-channel transistor including a gate connected to a drain of the P-channel transistor.

8. A voltage regulator according to claim 3, wherein the first transistor comprises an N-channel enhancement type transistor including a gate connected to a constant voltage circuit.

* * * * *

UNITED STATES PATENT AND TRADEMARK OFFICE

CERTIFICATE OF CORRECTION

PATENT NO. : 8,450,986 B2
APPLICATION NO. : 12/891341
DATED : May 28, 2013
INVENTOR(S) : Imura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 366 days.

Signed and Sealed this
Sixteenth Day of December, 2014

Michelle K. Lee

Michelle K. Lee
*Deputy Director of the United States Patent and Trademark Office*